US011913741B2

(12) United States Patent
Markut

(10) Patent No.: US 11,913,741 B2
(45) Date of Patent: Feb. 27, 2024

(54) FIREARM WITH SECURED FIRING PIN RETAINING PIN

(71) Applicant: GLOCK TECHNOLOGY GMBH, Ferlach (AT)

(72) Inventor: Karl Markut, Klagenfurt (AT)

(73) Assignee: GLOCK TECHNOLOGY GMBH, Ferlach (AT)

( * ) Notice: Subject to any disclaimer, the term of this patent is extended or adjusted under 35 U.S.C. 154(b) by 199 days.

(21) Appl. No.: 17/754,389

(22) PCT Filed: Sep. 25, 2020

(86) PCT No.: PCT/EP2020/076852
§ 371 (c)(1),
(2) Date: Mar. 31, 2022

(87) PCT Pub. No.: WO2021/063812
PCT Pub. Date: Apr. 8, 2021

(65) Prior Publication Data

US 2022/0341692 A1 Oct. 27, 2022

(30) Foreign Application Priority Data

Oct. 4, 2019 (EP) ..... 19201457

(51) Int. Cl.
*F41A 19/13* (2006.01)
*F41A 3/26* (2006.01)

(52) U.S. Cl.
CPC ..... *F41A 19/13* (2013.01); *F41A 3/26* (2013.01)

(58) Field of Classification Search
CPC ..... F41A 19/13; F41A 3/26
See application file for complete search history.

(56) References Cited

U.S. PATENT DOCUMENTS 3,648,562 A * 3/1972 Loeble ..... F41A 19/13 89/185
4,555,861 A * 12/1985 Khoury ..... F41A 17/72 42/70.08

(Continued)

FOREIGN PATENT DOCUMENTS

DE 460556 C 6/1928
DE 102007034670 A1 1/2009

(Continued)

*Primary Examiner* — Michelle Clement
(74) *Attorney, Agent, or Firm* — Raven Patents, LLC; Anton E. Skaugset

(57) ABSTRACT

Firearms including a secured firing pin retaining pin, the firearms having a barrel, a sliding block, a bolt head, a firing pin with a flange-like collar, a firing pin retaining pin with a safety device, and a weapon median plane. For facilitating handling, it is provided that the firing pin retaining pin is slidably mounted normally to the weapon median plane in a retaining bore, that it is designed as one piece and to be rotationally symmetrical with a head and a pin end and has two annular grooves. A locking pin mounted in a spring-loaded manner in the sliding block is designed such that, depending on the position of the firing pin retaining pin in the retaining bore, it can optionally engage in one of the annular grooves, which correspond to a holding position and a release position for the firing pin, respectively.

16 Claims, 3 Drawing Sheets

(56) References Cited

U.S. PATENT DOCUMENTS

| | | | | |
|---|---|---|---|---|
| 5,157,209 | A * | 10/1992 | Dunn | F41A 19/32 89/154 |
| 5,245,776 | A * | 9/1993 | Dornaus | F41A 21/48 42/144 |
| 6,405,470 | B1 * | 6/2002 | Strahan | F41A 17/02 42/70.11 |
| 6,415,702 | B1 * | 7/2002 | Szabo | F41A 17/56 42/70.08 |
| 7,204,051 | B2 * | 4/2007 | Thomele | F41A 17/72 42/70.08 |
| 7,444,775 | B1 | 11/2008 | Schuetz | |
| 7,698,845 | B2 * | 4/2010 | Hochstrate | F41A 17/72 42/69.01 |
| 7,703,230 | B2 * | 4/2010 | Curry | F41A 17/72 42/70.08 |
| 7,753,679 | B1 | 7/2010 | Schuetz | |
| 8,132,496 | B2 * | 3/2012 | Zukowski | F41A 17/66 89/142 |
| 8,245,427 | B2 * | 8/2012 | Gomez | F41A 17/66 89/154 |
| 8,276,302 | B2 * | 10/2012 | Zukowski | F41A 17/66 89/181 |
| 8,296,990 | B2 * | 10/2012 | Zukowski | F41A 17/66 42/111 |
| 8,800,422 | B2 * | 8/2014 | Norton | F41A 15/14 89/185 |
| 8,950,312 | B2 | 2/2015 | Gomez | |
| 9,228,786 | B2 * | 1/2016 | Sullivan | F41A 21/48 |
| 9,234,713 | B1 * | 1/2016 | Olson | F41A 9/41 |
| 9,746,262 | B2 * | 8/2017 | Fellows | F41A 19/13 |
| 10,175,019 | B1 * | 1/2019 | Al-Mutawa | F41A 17/72 |
| 10,215,513 | B2 * | 2/2019 | Cross | F41A 19/25 |
| 10,488,164 | B1 * | 11/2019 | Utt | F41A 19/13 |
| 10,571,213 | B1 * | 2/2020 | Sugg | F41A 3/30 |
| 10,948,249 | B2 * | 3/2021 | Overstreet | F41A 3/30 |
| 10,969,182 | B2 * | 4/2021 | Fellows | F41A 15/14 |
| 10,969,183 | B2 * | 4/2021 | Gibbens | F41A 19/13 |
| 11,029,115 | B2 * | 6/2021 | Serbu | F41A 5/18 |
| 11,486,664 | B2 * | 11/2022 | Gibbens | F41A 15/14 |
| 2015/0241149 | A1 | 8/2015 | McMillen, IV | |
| 2018/0164057 | A1 | 6/2018 | Steimke et al. | |
| 2023/0102280 | A1 * | 3/2023 | Gagne | F41A 3/26 42/70.08 |

FOREIGN PATENT DOCUMENTS

| | | |
|---|---|---|
| WO | 2017003576 A2 | 1/2017 |
| WO | 2019147723 A1 | 8/2019 |

* cited by examiner

FIREARM WITH SECURED FIRING PIN RETAINING PIN

TECHNICAL FIELD

The present disclosure relates generally to firearms, and more particularly to firearms having devices to secure the firing pin within the weapon.

BACKGROUND

In the case of firearms, a cartridge is fired, e.g., by means of a firing pin which strikes the percussion cap or the edge of the cartridge bottom. The firing pin is usually a metal pin and can, e.g., be driven and pushed onto the primer by a striker spring, by the impact of a hammer on the firing pin, or by the forward motion of the lock. The impact of the firing pin on the primer initiates a chemical reaction which causes the primer to explode, which in turn serves as the initial ignition of the propelling charge of a cartridge.

In modern firearms, the firing pin is guided by the bolt head to the primer; it can be installed to be axially freely movable.

In the installation state, an unintentional movement of the firing pin too far toward the rear and a possible falling out can be prevented with a means for stopping the firing pin, e.g., a cotter pin lying transversely to the longitudinal axis of the firing pin. Such a so-called firing pin retaining pin (or firing pin cotter pin, firing pin stop bolt) is known, for example, from the M4/M16 or AR15 rifle systems.

English terms also frequently used in German are: firing pin retaining pin, firing pin retainer, firing pin retain pin, firing pin cotter pin, retainer pin, cotter pin.

In the prior art, the firing pin retaining pin must be removed in order to be able to extract the firing pin when the lock is disassembled, e.g., for cleaning purposes.

It is very common for firing pin retaining pins to incorporate a cotter pin. Such embodiments are known, for example, from U.S. Pat. Nos. 7,753,679 B1, 7,444,775 B1, US2015241149 A1, U.S. Pat. Nos. 9,234,713 B1, 9,625,232 B2. The contents of these documents and of U.S. Pat. No. 8,950,312 B2 are hereby incorporated by reference, for all purposes.

U.S. Pat. No. 8,950,312 B2 discloses a locking piece with a specifically-shaped recess for the firing pin cotter pin. The specific shape of the recess allows for an orientation of the firing pin cotter pin, and so the backward movement of the firing pin acts on the broadside of the firing pin cotter pin.

If the locking piece must be disassembled, e.g., for cleaning purposes, or if the firing pin must be removed from the locking piece, e.g., to be able to replace the firing pin, the firing pin cotter pin must be pulled out to be completely separated from the locking piece. Such removal of the cotter pin from the locking piece is possible only with the aid of tools. In the case of a disassembly, the required complete separation of the cotter pin from the locking piece and/or the absence of a safeguard against the falling out of the cotter pin is further disadvantageous because there is the possibility of losing the firing pin retaining pin. This is particularly disadvantageous during use in the field. In addition, guiding the cotter pin through the corresponding bore during reassembly is made more difficult by the slightly curved cotter pin limbs, which can be detrimental particularly in the field in adverse visibility and weather conditions.

A further disadvantage of cotter pin-like solutions is the possible sagging and bending of the firing pin cotter pin due to the repeated selective mechanical load on one and the same spot when the firing pin hits the firing pin retaining pin. This can even lead to a breakage of the firing pin cotter pin, which in turn is particularly disadvantageous when used in the field. A bent firing pin cotter pin complicates disassembly and reassembly of the locking piece; sometimes it can even become necessary to replace the firing pin retention pin.

DE102007034670A1 discloses a spring-mounted transverse bolt for securing the firing pin against falling out. The transverse bolt is securely connected at one end to the lock carrier by a spring in the bore provided for the bolt. If the thus spring-mounted transverse bolt is pressed axially inwards, a recess in the transverse bolt clears the way for the firing pin and it can be removed. The disadvantage is the lack of retention and the missing end stop of said transverse bolt. It can also be inadvertently pressed inwards, and the firing pin can fall out of the locking piece in an unrestricted manner. Another disadvantage is the elaborate multi-piece design which precludes an economic and cost-effective production. Furthermore, a replacement of the spring-mounted transverse bolt is possible only with the significant aid of tools.

WO 2019/147723 A1 discloses an ambidextrous firearm bolt assembly with an elongated bolt head for being configured to left or right side ejection of fired cartridges. This document shows a firing pin retention pin as a final securement pin for the bolt assembly, being located proximate an end of the bolt body opposite the head and being secured by a ball detent, thus reflecting an additional safety in the end position or holding position of the retaining pin.

For the above reasons, there is a need for a firing pin retaining pin which does not exhibit the disadvantages described in the prior art, but is as reliable as possible, easy to replace and designed in a loss-proof manner. The problem addressed by the present disclosure is that of providing such a safeguard.

SUMMARY

The present disclosure is directed to firearms having firing pin retention systems that are more elegant in design, more straightforward to manufacture, and simpler to operate than conventional firing pin retention systems.

In one example, the present disclosure is directed to firearms having a weapon median plane, where the firearms include a barrel; a sliding block; a bolt head; a firing pin, the firing pin being designed as one piece and having a flange-like collar, and a firing pin retaining pin having a safety device; where the firing pin retaining pin is slidably mounted normally to the weapon median plane in a retaining bore; and where the firing pin retaining pin is rotationally symmetrical having a head, a pin end, and two annular grooves. The firearm further includes a locking pin mounted in a spring-loaded manner in the sliding block, where the locking pin is designed to releasably engage with the annular grooves of the firing pin retaining pin when the firing pin retaining pin is in either a holding position or a release position within the retaining bore.

BRIEF DESCRIPTION OF THE DRAWINGS

In the following, the embodiments of the present disclosure shall be explained in more detail with reference to the drawings.

DETAILED DESCRIPTION

Figure 1:
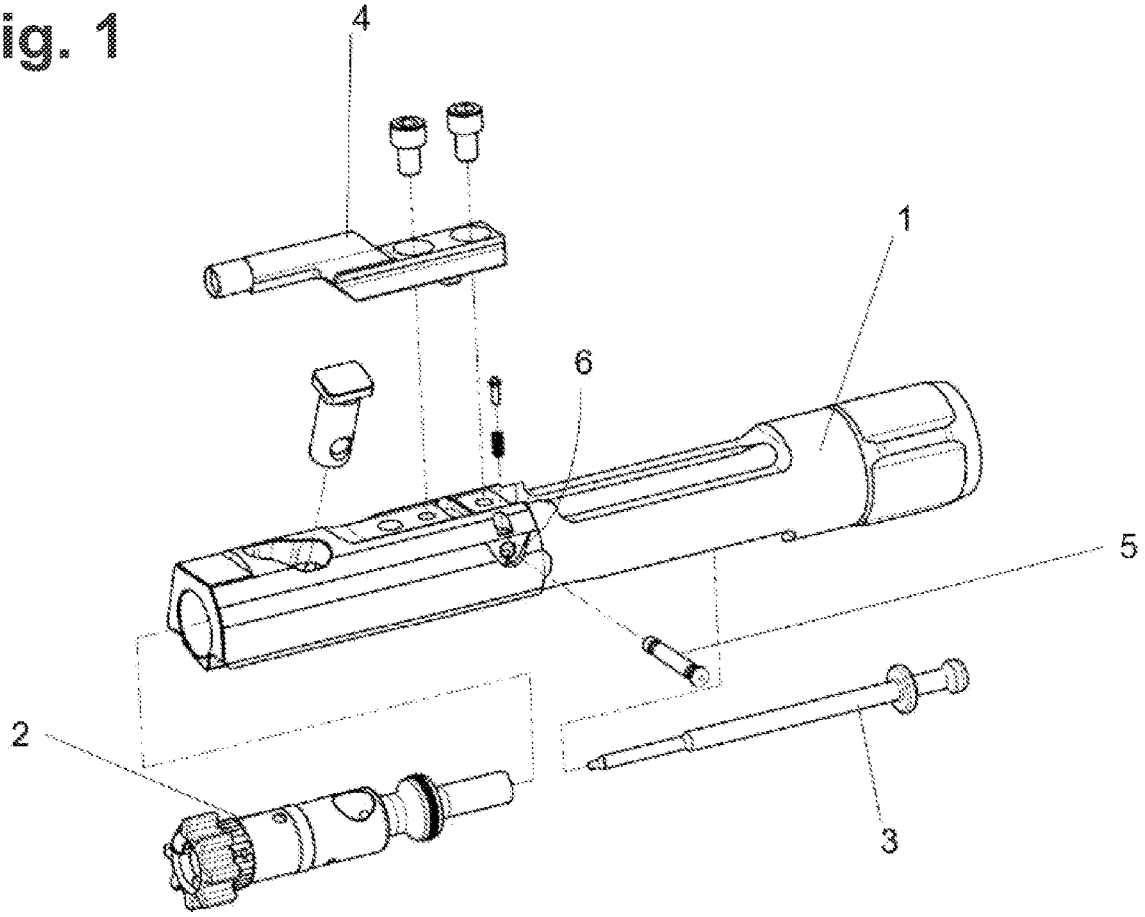
FIG. 1 shows an exploded view of an exemplary locking piece, designed according to the present disclosure, with its components.

The problems associated with prior art firing pin retention systems may be solved by the features of the firing pin retention system of the present disclosure. In other words:

- the firing pin retaining pin has a one-piece design and is movably arranged in a rotationally symmetrical manner with a double stop in a retaining bore;
- it is locked in place by engaging a spring-mounted locking pin in annular grooves of the firing pin retaining pin;
- a first stop prevents an unintentional opening of the closed position (holding position);
- an end stop prevents that it unintentionally falls out of the sliding block (release position);
- a device for holding down the spring-mounted locking pin is provided.

The present firing pin retention system makes it possible that:

Due to the simple design without threads and permanent connections, only a small number of parts is required, which allows for a cost-effective production.

Due to the inventive design of grooves on the firing pin retaining pin for a locking with the first stop and the end stop, an unintentional shifting from the intended position is prevented. This means that the unintentional release of the movement of the firing pin toward the rear and a falling out of the firing pin during use of the firearm are prevented when locked in place in the first stop; the firing pin remains securely in its installation position. When locked in place in the end stop, an unintentional falling out of the firing pin retaining pin is prevented (loss protection).

A removal of the firing pin retaining pin from the sliding block during normal use is not provided. As a result, even in the case of an intended and required removal of the firing pin (e.g., for cleaning purposes, for inspection or replacement of the firing pin), loss of the firing pin retaining pin, especially in the field and/or in poor weather/visibility conditions, is efficiently prevented.

The reassembly, e.g., after a completed firing pin replacement, is facilitated when compared to the prior art because the firing pin retaining pin according to the present disclosure must be pressed into position with, e.g., only one finger once the firing pin is reintroduced. The firing pin retaining pin is essentially handled without tools; if necessary, a cartridge tip can be used as an aid. For this purpose, the end of the firing pin retaining pin is preferably provided with a specific shape, e.g., a conical or semispherical shape. In order to prevent slippage when using a cartridge tip, an additional, e.g., conical or frustoconical, inward facing recess with a smaller diameter can be present. The bore of the firing pin retaining pin on the sliding block can, at least on one side (e.g., on the side of the pin end or the head), preferably on both sides, also have a specific shape, e.g., a conical or frustoconical depression. Such a shape on the sliding block supports the "anti-slip" effect and allows for a flush alignment of the retaining pin with the sliding block.

However, if a complete separation of the firing pin retaining pin from the sliding block is necessary, it can be achieved with the help of only a simple means (e.g., a cartridge or possibly a small screwdriver).

The specific shape of the head of the firing pin retaining pin, i.e., the flange-shaped design protruding with regard to the diameter, allows for a particularly easy handling and extraction of the firing pin retaining pin without the aid of tools.

In a preferred embodiment, the head of the firing pin retaining pin can have an additional shape on the flange-shaped design, which is haptically particularly favorable and which also facilitates the handling, e.g., with the fingers and/or the fingernails. Such a preferred shape, which in addition is haptically particularly favorable, can be designed, e.g., as a notch, step, or recess.

A further aspect of the present disclosure relates to the circular, thus rotationally symmetrical shape of the firing pin retaining pin. As a result, it can be easily inserted into its retaining bore without the aid of tools. The occurring mechanical stress due to the backward movement of the firing pin during operation is diverted particularly well, and the occurrence of cracks due to an undesirable notch effect is minimized. Such a notch effect occurs on material edges, which the rotationally symmetrical firing pin retaining pin according to the present disclosure does not have, particularly in the circumferential direction. In addition, a simple and inexpensive production is possible.

FIG. 1 shows an exploded view of a sliding block 1 according to the present disclosure with a bolt head 2, a firing pin 3, a so-called gas deflection piece 4, a firing pin retaining pin according to the present disclosure, in the following frequently called retaining pin 5, for short, and a retaining bore 6 for receiving the retaining pin 5. The gas deflection piece is only shown to complete the drawing. At its one, front end, the firing pin 3 has, as initially described, a firing pin tip which, upon firing, pushes against the cartridge, and at its other, rear end, it has a thickening. At a distance from the thickening, a flange-like collar is provided which projects radially over the lateral surface of the firing pin 3. A locking pin and its spring, without a reference sign due to the small size, are also shown near the reference sign 6 in order to illustrate their installation situation, which shall be explained below.

Figure 2:
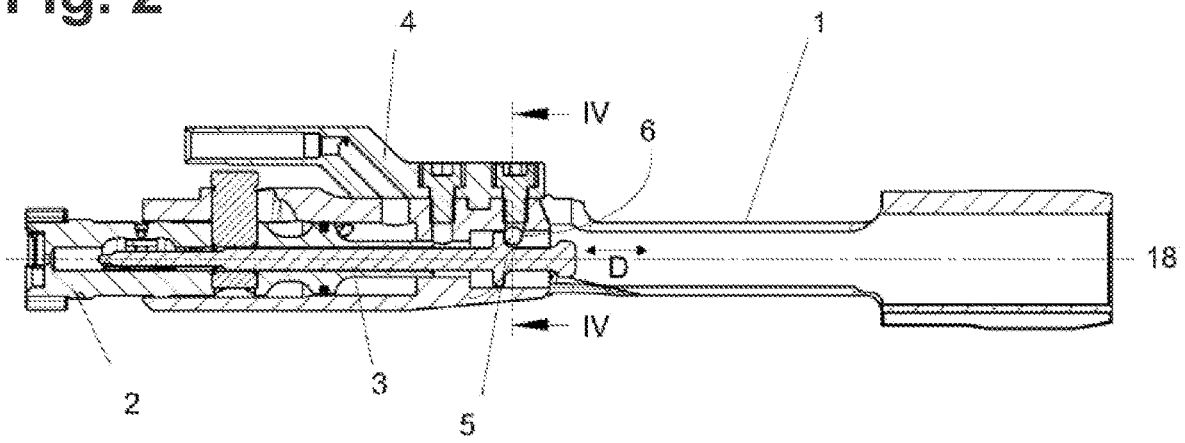
FIG. 2 shows a longitudinal section of the locking piece of FIG. 1 with firing pin and retaining pin in the installation state.

FIG. 2 shows a longitudinal section in the weapon median plane of the sliding block 1 with bolt head 2, firing pin 3, and the gas deflection piece 4 together with the retaining pin 5 in its retaining bore 6 in the installation state. The firing pin 3 which, corresponding to the axis of the barrel bore or barrel axis, is freely movable in the direction of its longitudinal axis, is delimited in its movement to the rear (indicated by the double arrow D) by the retaining pin 5, which bears against the collar. The falling out of the firing pin 3 from the bolt head 2 during use of the firearm is thus prevented. If the firing pin 3 moves forward, said movement is delimited, as in the prior art, either by the impact of the tip on the cartridge, or the impact of the collar on the narrowing of the firing pin bore, or another form-locking design.

Figure 3:
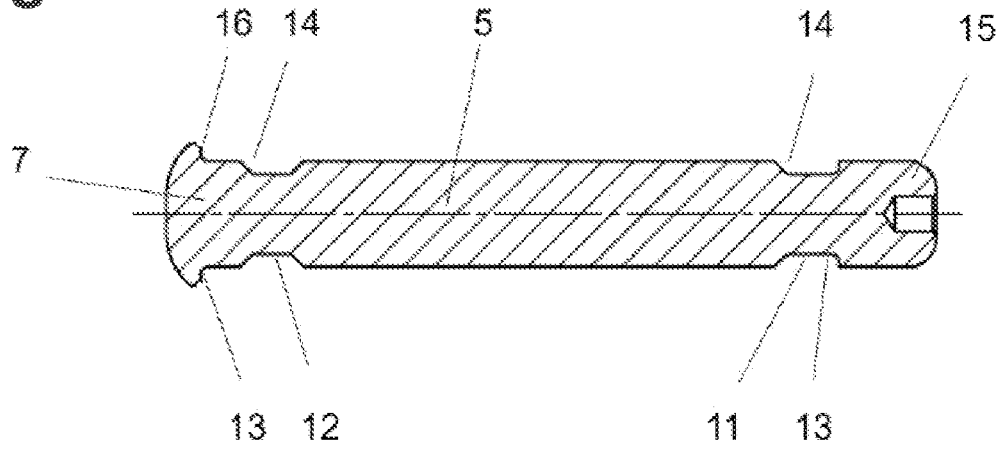
FIG. 3 shows a detailed view of an exemplary firing pin retaining pin according to the present disclosure.

FIG. 3 shows an enlarged detailed view of the retaining pin 5 as an axial section with its head 7 with its preferably haptic design 16, herein in the form of a notch. Two annular grooves near the two ends of the retaining pin 5 each form a catch, wherein a first annular groove near the head 7 forms the first stop 12, and the second annular groove near the pin end 15 forms the end stop 11. In the following, for reasons of technical conformance, the first groove, similar to the first stop, shall be denoted with "12," and the second groove, similar to the end stop, shall be denoted with "11." In the description and claims, "near one end" refers to a distance of no more than one third of the length of the retaining pin 5, wherein—when viewed axially—the center of the annular groove is considered. It particularly refers to a quarter and very particularly to one fifth of the length.

The second groove forming the end stop is shown in its preferred form, with a conical flank, which forms a run-up slope 14 towards the center of the retaining pin 5, and with a flank running normally to the axis of the retaining pin 5, which forms a locking edge 13. The pin end 15 is also shown in a preferred embodiment, namely with a central indentation, herein in the form of a blind hole. As a result, a simple tool (nail, cartridge tip, etc.) can be applied without slippage. The first groove forming the first stop 12 has two oblique flanks 14.

Figure 4:
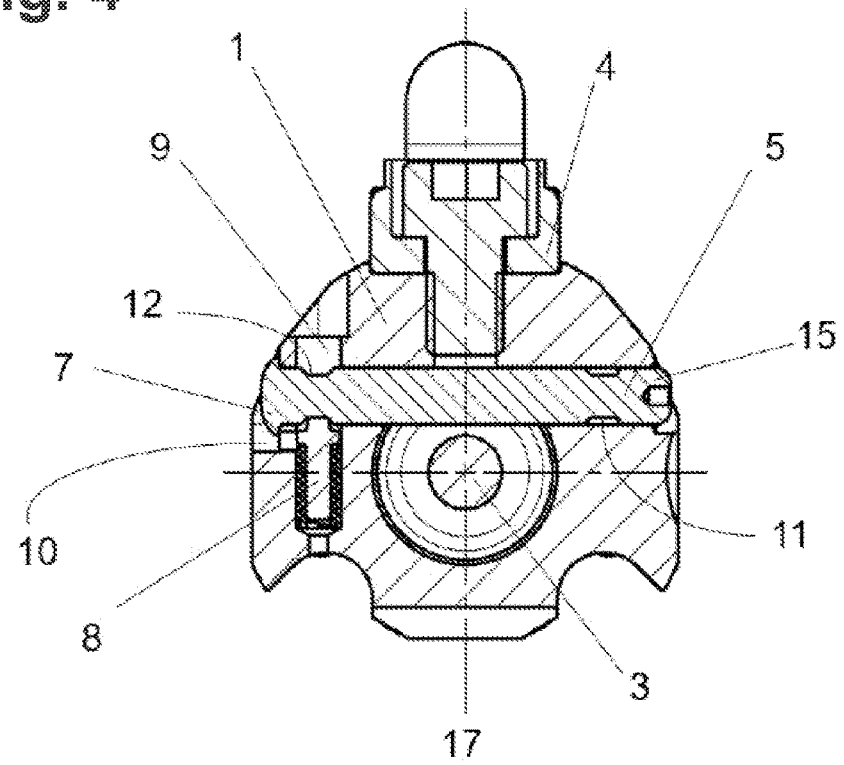
FIG. 4 shows a cross-section of the firing pin retaining pin of the present disclosure in the installation state (closed)

FIG. 4 shows a sectional view normal to the firing pin axis 18 and through the axis of the retaining pin 5, according to the section IV-IV of FIG. 2. The retaining pin 5 is shown in its installation situation, position: "closed." This means, as can be seen, that it lies entirely in its retaining bore 6. A further movement of the head 7, directed inwardly toward the weapon median plane 17, is prevented either by the interaction of the first stop 12 with a locking pin 8, or by the interaction of the head 7 with the outer contour of the sliding block 1. As a combination with FIG. 2 shows, it lies with its full cross-section between the collar and the thickened end of the firing pin, thus securing it against falling out.

The locking pin 8 is seated in a locking pin bore 9 and is under the effect of a spring which pushes it toward the retaining pin 5. As shown, the locking pin 8 preferably has a head that correlates in shape and size with the first stop 12. This means that it touches both flanks and the bottom of the first groove practically free of play, as far as this is technically possible. Thus, the locking pin 8 prevents an unintentional axial movement or even loosening of the retaining pin 5 from the "closed" position or holding position.

Figure 5:
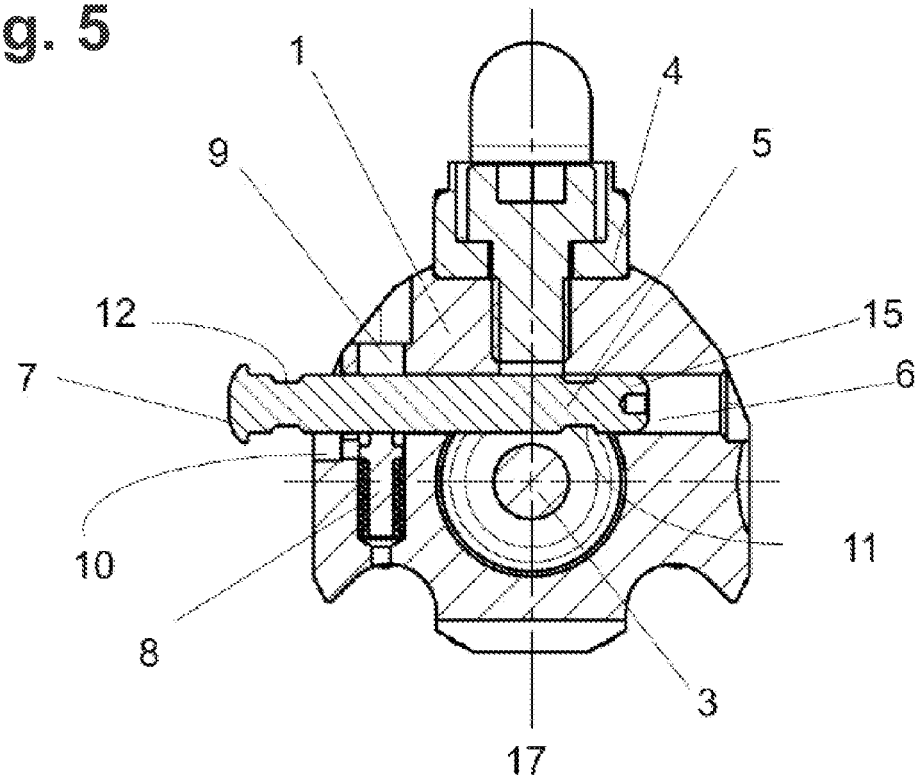
FIG. 5 shows a cross-section of the firing pin retaining pin of the present disclosure in the middle position.

FIG. 5 shows the retaining pin 5 in an undefined and non-engaged center position between "open" and "closed," which is achieved by manually pulling by the head 7, proceeding from the position shown in FIG. 4, possibly with the aid of a cartridge tip, and pressing on the pin end 15. Due to the inner run-up ramp 14 of the first groove of the first stop 12, the locking pin 8 is pushed against the force of its spring in a downward direction, and the firing pin retaining pin 5 can be moved, but not unintentionally, in the outward direction without tools (possibly with the aid of a cartridge tip).

By pressing on the head 7, the retaining pin 5 can be moved inwardly from the center position back to the closed position, in which the spring-mounted locking pin 8 in turn meshes with and engages in the first groove of the first stop 12.

Figure 6:
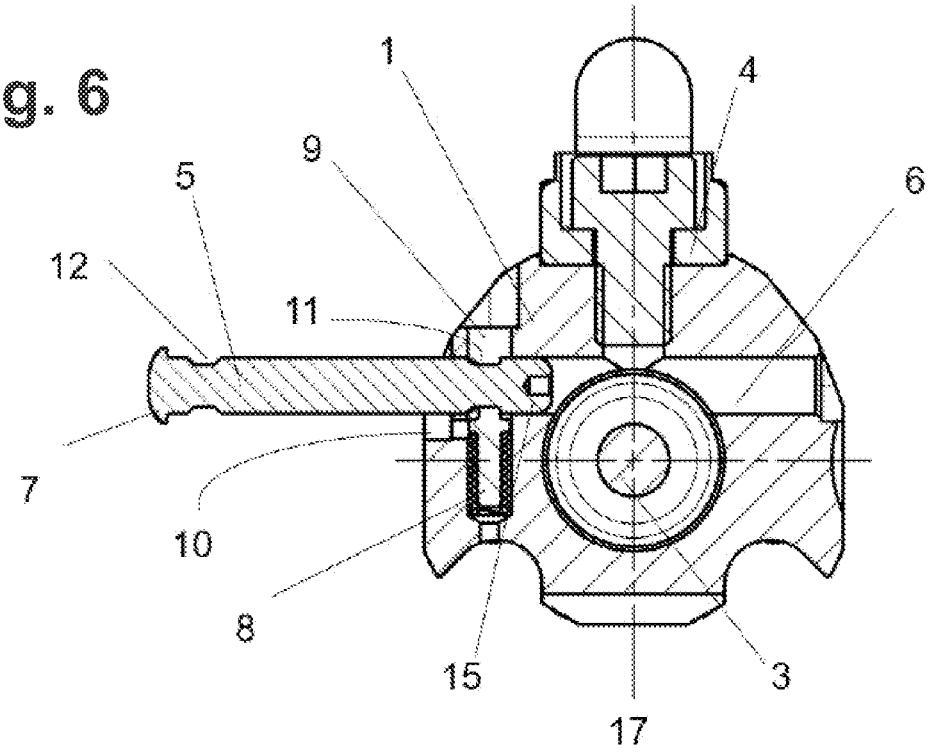
FIG. 6 shows a cross-section of the firing pin retaining pin of the present disclosure in the open position.

From the center position, the retaining pin 5 can also be moved outwardly to engage in the "open" position (release position) by pulling it further out, which is shown in FIG. 6. The locking pin 8 engages in the second groove of the end stop 11 and a further outward movement of the retaining pin 5 is prevented by the locking edge 13, which cannot move the locking pin. During normal operation of the weapon, the retaining pin 5 therefore remains connected to the sliding block 1 in a loss-proof manner due to the mechanism according to the present disclosure. The run-up slope 14 on the inner side of the second groove of the end stop 11 allows the sliding of the locking pin 8 in the downward direction against the effect of its spring when the retaining pin 5 is pushed inward, resulting in the further movement of the retaining pin 5 in the inward direction to the "closed" position. This movement can be achieved without tools, e.g., by pressing with one finger.

A complete removal of the retaining pin 5 from the locking piece 1 is possible from the central position, FIG. 5, as follows: By means of a simple means (e.g., a cartridge) or, if available, a simple tool (e.g., a small flathead screwdriver), the locking pin 8 is pressed downward via a maintenance opening 10. As a result, the movement of the retaining pin 5 in the outward direction is also possible via the locking edge 13 of the end stop 11, and the retaining pin 5 can be removed from the sliding block 1.

The retaining pin 5 is reinserted in the opposite movement direction, which is also possible without a tool, provided that its end 15 has an at least slight rounding or bevel. The pin end 15 can be provided by any non-abrupt angular form of the transition from vertical to horizontal, actually from the cylinder jacket to the end (e.g., conical, semispherical, partially spherical, also frustum-shaped with bevels), which, when inserted into the retaining bore 6, pushes the spring-mounted locking pin 8 downward, thus releasing the inward movement.

For applying a means for pushing from this side of the retaining pin 5, the pin end 15 can also have a form particularly useful for the non-slip engaging of simple means, such as an axially centered, semispherical, conical, or frustoconical inward depression with a small diameter.

The head 7 of the retaining pin 5, preferably mushroom-shaped, has an improved haptic shape 16 of the surface, e.g., as a notch or stepped, to allow an engaging with fingernails, thereby facilitating a tool-free handling.

The spring-mounted locking pin 8 is secured by the retaining pin 5 and, after its removal via the locking pin bore 9, it can be extracted and inserted again, if necessary.

In a development, the opening of the retaining bore 6 on the sliding block 1 has, on the side of the head 7 of the retaining pin 5, a conical indentation/depression, which facilitates an engaging of the head 7 from behind for pulling out the retaining pin 5. Said indentation/depression allows for a flush alignment of the head 7 with the sliding block and thus a frictionless movement of the sliding block in the firearm during use.

In a further embodiment of the present disclosure, the opening of the retaining bore 6 on the sliding block 1 (or said sliding block 1) on the side of the pin end 15 has a conical indentation/depression. This allows for a simpler and easier operation, e.g., by means of self-centering and/or an "anti-slip effect" when using a finger or simple means, such as a cartridge tip, when the retaining pin 5 is pushed out from the "closed" position in the direction of the weapon median plane 17.

In summary, it can be noted that the present disclosure relates to a firearm having a barrel, a sliding block (1), a bolt head (2), a firing pin (3) with a flange-like collar, a firing pin retaining pin (5) with a safety device, and a weapon median plane (17).

For facilitating the handling, it is provided according to the present disclosure that the firing pin retaining pin (5) is slidably mounted normally to the weapon median plane (17) in a retaining bore (6), that it is designed as one piece and to be rotationally symmetrical with a head (7) and a pin end (15) and has two annular grooves. A locking pin (8) mounted in a spring-loaded manner in the sliding block (1) is designed such that, depending on the position of the firing pin retaining pin (5) in the retaining bore (6), it can optionally engage in one of the annular grooves, which corresponds to a holding position or a release position for the firing pin.

LIST OF REFERENCE SIGNS

| | |
|---|---|
| 1 | Sliding block |
| 2 | Bolt head |
| 3 | Firing pin |
| 4 | Gas deflection piece |
| 5 | Retaining pin |
| 6 | Retaining bore |
| 7 | Head |
| 8 | Locking pin |
| 9 | Locking pin bore |
| 10 | Maintenance opening |
| 11 | End stop, groove |
| 12 | First stop, groove |
| 13 | Locking edge |
| 14 | Run-up slope |
| 15 | Pin end |
| 16 | Haptic shape |
| 17 | Weapon median plane |
| 18 | Firing pin axis |

The invention claimed is:

1. A firearm having a weapon median plane, the firearm comprising:

a barrel;

a sliding block;

a bolt head;

a firing pin, the firing pin being designed as one piece and having a flange-like collar, and a firing pin retaining pin having a safety device; wherein the firing pin retaining pin is slidably mounted normally to the weapon median plane in a retaining bore; and wherein the firing pin retaining pin is rotationally symmetrical having a head, a pin end, and a first and a second annular grooves; and a locking pin mounted in a spring-loaded manner in the sliding block; wherein the locking pin is designed to releasably engage with the first or the second annular grooves of the firing pin retaining pin when the firing pin retaining pin is in either a holding position or a release position within the retaining bore.

2. The firearm according to claim 1, wherein a first annular groove of the firing pin retaining pin is arranged near the head of the firing pin retaining pin and forms a first stop; and a second annular groove of the firing pin retaining pin is arranged near the pin end of the firing pin retaining pin and forms an end stop; and the first annular groove is arranged on the firing pin retaining pin at a maximum distance of one- third of a length of the firing pin retaining pin from the head of the firing pin retaining pin; and the second annular groove is arranged on the firing pin retaining pin at a maximum distance of one-third of the length of the firing pin retaining pin from the end of the firing pin retaining pin.

3. The firearm according to claim 2, wherein an engagement of the locking pin with the first annular groove retains the firing pin retaining pin in the holding position, such that the firing pin retaining pin lies in a motion path of the flange-like collar of the firing pin and thereby retains the firing pin within the sliding block.

4. The firearm according to claim 2, wherein an engagement of the locking pin with the second annular groove retains the firing pin retaining pin in the release position, such that the firing pin retaining pin does not lie in a motion path of the flange-like collar of the firing pin and thereby permits the firing pin to be removed from the sliding block.

5. The firearm according to claim 2, wherein the second annular groove forming the end stop defines, on a side nearest the pin end, a flank that runs normally to an axis of the firing pin retaining pin and that acts as a locking surface.

6. The firearm according to claim 2, wherein the first annular groove forming the first stop defines, on both sides of the first annular groove, flanks that run obliquely to an axis of the firing pin retaining pin, each flank forming a run-up slope.

7. The firearm according to claim 1, wherein an end of the locking pin that faces the firing pin retaining pin corresponds in shape and size to a cross-sectional shape of at least one of the first and second annular grooves.

8. The firearm according to claim 7, wherein the end of the locking pin that faces the firing pin retaining pin corresponds in shape and size to the cross-sectional shape of the first annular groove.

9. The firearm according to claim 2, wherein the locking pin is slidably mounted within a locking pin bore defined in the sliding block, and the locking pin bore intersects the retaining bore such that the locking pin can be extracted from the sliding block when the firing pin retaining pin is removed.

10. The firearm according to claim 9, the sliding block further defining a maintenance opening that leads from a surface of the sliding block to the locking pin bore, wherein the maintenance opening permits the locking pin to be pushed against a force of its spring and away from an area of the end stop of the firing pin retaining pin, enabling the firing pin retaining pin to be removed from the sliding block.

11. The firearm according to claim 1, wherein the pin end of the firing pin retaining pin has an essentially conical, dome-like, or semispherical shape.

12. The firearm according to claim 1, wherein the pin end of the firing pin retaining pin defines an indentation in its axial area.

13. The firearm according to claim 12, wherein the indentation is a blind bore in a form of a conical or a semispherical depression.

14. The firearm according to claim 1, wherein the head of the firing pin retaining pin is mushroom-shaped.

15. The firearm according to claim 1, wherein one or both openings of the retaining bore include a conical indentation or depression in a side of the sliding block.

16. The firearm according to claim 15, wherein the openings of the retaining bore include a conical indentation or depression on both sides of the sliding block.

* * * * *